US007364138B2

(12) United States Patent
Prager

(10) Patent No.: US 7,364,138 B2
(45) Date of Patent: Apr. 29, 2008

(54) MEMBRANE CARBURETOR

(75) Inventor: André Prager, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/698,140

(22) Filed: Jan. 26, 2007

(65) Prior Publication Data

US 2007/0182032 A1 Aug. 9, 2007

(30) Foreign Application Priority Data

Feb. 8, 2006 (DE) ..... 10 2006 005 696

(51) Int. Cl.
*F02M 7/08* (2006.01)

(52) U.S. Cl. ..... 261/34.2; 261/35

(58) Field of Classification Search ..... 261/34.2, 261/35, 69.1, 69.2
See application file for complete search history.

(56) References Cited

U.S. PATENT DOCUMENTS

| | | | | |
|---|---|---|---|---|
| 3,807,710 | A * | 4/1974 | Bergamini | 261/39.2 |
| 5,250,233 | A | 10/1993 | Swanson | |
| 6,293,524 | B1 * | 9/2001 | Endo et al. | 261/34.2 |
| 6,481,698 | B1 * | 11/2002 | Calvin et al. | 261/23.2 |
| 6,595,500 | B2 * | 7/2003 | Osburg et al. | 261/34.2 |
| 6,736,613 | B2 * | 5/2004 | Nagata | 417/415 |
| 6,938,884 | B2 * | 9/2005 | Knaus et al. | 261/34.2 |
| 7,000,906 | B2 * | 2/2006 | Geyer et al. | 261/34.2 |
| 7,172,178 | B1 * | 2/2007 | Hacker | 261/34.2 |
| 2002/0158349 | A1 * | 10/2002 | Osburg et al. | 261/34.2 |
| 2002/0163087 | A1 * | 11/2002 | Gerhardy | 261/34.2 |
| 2007/0052116 | A1 * | 3/2007 | Ishii | 261/34.2 |
| 2007/0063357 | A1 * | 3/2007 | Iwasa et al. | 261/34.2 |

FOREIGN PATENT DOCUMENTS

| | | | | |
|---|---|---|---|---|
| JP | 60-75750 A | * | 4/1985 | 261/34.2 |
| JP | 3-172564 A | * | 7/1991 | 261/34.2 |
| JP | 5-164001 A | * | 6/1993 | 261/34.2 |

* cited by examiner

*Primary Examiner*—Richard L. Chiesa
(74) *Attorney, Agent, or Firm*—Walter Ottesen

(57) ABSTRACT

A membrane carburetor (1) has a control chamber (13) which is connected via at least one fuel opening (9, 10) to an intake channel (3). The control chamber (13) is delimited by a control membrane (14). A fuel line (54) opens into the control chamber (13) via an inlet valve (15). The inlet valve (15) opens in dependence upon the deflection of the control membrane (14). The membrane carburetor (1) has an acceleration pump (30) which is actuated in dependence upon the position of a throttle element held in the intake channel (3). A good acceleration enrichment and a stable running of the internal combustion engine are achieved when the acceleration pump (30) operates hydraulically on at least one actuating member in the control chamber (13).

22 Claims, 3 Drawing Sheets

MEMBRANE CARBURETOR

CROSS REFERENCE TO RELATED APPLICATION

This application claims priority of German patent application no. 10 2006 005 696.5, filed Feb. 8, 2006, the entire content of which is incorporated herein by reference.

FIELD OF THE INVENTION

The invention relates to a membrane carburetor including a membrane carburetor for a portable handheld work apparatus such as a motor-driven chain saw, brushcutter or the like.

BACKGROUND OF THE INVENTION

U.S. Pat. No. 5,250,233 discloses a membrane carburetor having a control chamber delimited by a control membrane and an acceleration pump actuated by a throttle shaft. The acceleration pump includes a pump chamber which is connected via a line to the control chamber. The line opens into the control chamber in the region of fuel openings opening into the intake channel.

The pump chamber of the acceleration pump defines a dead space wherein fuel is drawn in by suction only at pregiven operating conditions or fuel is pumped out. During constant operation in a load state, the volume of the pump chamber remains unchanged and no throughflow of fuel through the pump chamber takes place. In this way, air bubbles can collect in the pump chamber during longer operating times. If these air bubbles are moved into the intake channel during a later acceleration operation, then instability in the running performance of the internal combustion engine and increased exhaust-gas values occur.

SUMMARY OF THE INVENTION

It is an object of the invention to provide a membrane carburetor of the kind described above wherein a stable running performance of the engine is achieved also over longer operating times.

The membrane carburetor of the invention includes: a control chamber; an intake channel; at least one fuel opening connecting the control chamber to the intake channel; a deflectable control membrane delimiting the control chamber; fuel supply means for supplying fuel to the control chamber; the fuel supply means including an inlet valve; and, a fuel line opening into the control chamber via the inlet valve; the control membrane being operatively connected to the inlet valve so as to open in dependence upon deflections of the control membrane; a throttle element mounted in the intake channel so as to be moveable in position; an accelerator pump operatively connected to the throttle element so as to be actuated in dependence upon the position of the throttle element; the control chamber having an actuating member; and, the accelerator pump being hydraulically connected to the actuating member so as to permit the accelerator pump to act hydraulically on the actuating member.

It has been shown that the disadvantages of the known acceleration pump can be avoided when the acceleration pump does not pump fuel directly into the control chamber or to the fuel openings but rather, when there is an intervention into the control performance via the acceleration pump. This is achieved in that the acceleration pump operates hydraulically on an actuating member in the control chamber. With the term "actuating member", all components of the control chamber are designated which influence the fuel quantity supplied to the intake channel. The hydraulic action on an actuating member of the control chamber leads to a direct change of the supplied fuel quantity. In this way, an acceleration enrichment can be achieved in a simple manner. Air bubbles, which collect in the acceleration pump, are not supplied to the control chamber. Accordingly, a supply of air into the fuel system is avoided so that a stable running operation can be achieved.

It is provided that the acceleration pump has a pump piston and the pump piston delimits a pump chamber and a pressure line leads away from the pump chamber via which the acceleration pump acts on the actuating member. To ensure especially during starting that the acceleration pump is completely filled with fuel, the pump chamber is connected via a first suction line to a scavenging pump. The first suction line opens into a region of the pump chamber which is closed by the pump piston when the pump piston is actuated. In advance of the start of the internal combustion engine, the scavenging pump can be actuated and so the pump chamber is completely flushed with fuel. During acceleration, the first suction line is closed by the movement of the pump piston so that the fuel, which is disposed in the pump chamber, completely acts on the actuating member and cannot escape to the scavenging pump.

Advantageously, a second suction line opens into the pump chamber which connects the pump chamber to the control chamber. In the second suction line, a check valve is mounted which opens in the flow direction toward the pump chamber. In this way, a quick scavenging of the pump chamber and a rapid filling of the pump chamber during deceleration operations are achieved so that the acceleration pump is rapidly again available for subsequent acceleration operations. The pump chamber can be scavenged with the scavenging pump via the suction line. During decelerations, fuel can flow back from the control chamber into the pump chamber via the second suction line. The second suction line can be configured with a comparatively large flow cross section so that a rapid filling of the pump chamber results. The check valve ensures that, during the pump stroke, the total fuel present in the pump chamber actuates the actuating member via the pressure line and cannot escape to the control chamber via the suction line. In the pressure line, a check valve can be mounted which opens in flow direction from the pump chamber. In this way, it is ensured that the filling of the pump chamber always takes place via the suction line. The characteristic of the acceleration pump can be well adjusted in this manner.

Advantageously, the actuating member is the inlet valve of the membrane carburetor. During acceleration, the throttle flap is opened in the intake channel. This leads to a pressure drop in the intake channel. For this reason, an increased fuel quantity is drawn by suction from the control chamber via the fuel opening into the intake channel. The induction of the increased fuel quantity leads to a pressure drop in the control chamber which effects a deflection of the control membrane and, in known membrane carburetors, an opening of the inlet valve via the coupling device. Since the effects take place sequentially in time, a time delay is present between the opening of the throttle element and the opening of the inlet valve. Because the inlet valve is immediately opened by the acceleration pump during accelerations, on the one hand, a pressure increase is achieved in the control chamber which effects the supply of increased fuel quantity to the intake channel. On the other hand, the delay is avoided which lies between the opening of the throttle element and the opening of the inlet valve in known membrane carburetors so that also the leaning of the mixture caused by the delay is avoided during the acceleration operation. In order to avoid an increased supply of fuel during deceleration, it is provided that the inlet valve is closed during deceleration by the acceleration pump.

However, it can also be provided that the actuating member is the control membrane. In that the acceleration pump acts on the control membrane and the control membrane is so deflected that a pressure increase results in the control chamber, it is achieved that an increased quantity of fuel is supplied to the intake channel. Advantageously, the acceleration pump acts on a lever which couples the position of the inlet valve to the position of the control membrane. The acceleration pump can therefore act via the lever on the inlet valve as well as on the control membrane or only on the inlet valve or the control membrane. The lever is especially pivotally supported and the control membrane is coupled to the movement of the lever in both pivot directions. For an increased pressure in the control chamber, the coupling of the control membrane to the inlet valve causes the inlet valve to be closed. In the opposite direction, the coupling causes the control membrane to be pulled in the direction toward the control chamber with an actuation of the lever by the acceleration pump so that a pressure increase results in the control chamber and an acceleration enrichment is achieved. Advantageously, the control membrane is coupled with play to the movement of the lever.

The pressure line is connected to the control chamber via a throttling device. The pressure, which is present in the pressure line, can drop via the throttling device. For an acceleration, the actuating member is actuated via the pressure line. The pressure, which is present in the pressure line, is reduced via the throttling device and the actuating member can reset. The throttling device thereby prevents a continuous enrichment after an acceleration operation. The actuating member can advantageously be reset into the start position with a spring.

The actuating member is actuated via an actuating piston which delimits a pressure chamber into which the pressure line opens. A simple configuration results when the throttling device is configured as a discharge bore in the actuating piston. Advantageously, the actuating piston acts on the lever which couples the position of the inlet valve to the position of the control membrane. In order to make possible that the actuating piston can act on the lever when there is a deceleration, the actuating piston is connected via a fixation to the lever which transmits a stroke of the actuating piston in both directions to the lever. During the deceleration, the actuating member is reset thereby.

Advantageously, the pressure line opens into the control chamber at a nozzle and the actuating member is actuated by the fluid jet exiting from the nozzle. The nozzle especially acts upon the lever which couples the position of the inlet valve to the position of the control membrane. A spoon-shaped section is formed on the lever which engages over the nozzle discharge opening. An acceleration pump of this kind can be simply configured. The spoon-shaped section ensures an adequate attack surface for the exiting fluid jet. The forces needed for opening the inlet valve or for deflecting the control membrane for an enrichment of the mixture in the intake channel are very low. Also, a discharging fluid jet is therefore sufficient to generate an actuating movement for the actuating member.

The inlet valve has a control body which is fixedly connected to the valve body of the inlet valve. Advantageously, the control body is configured as an actuating piston which delimits a pressure chamber into which the pressure line opens. With the configuration of the control body itself as an actuating piston, no additional components are needed. The control body can also be configured as one piece with the valve body of the inlet valve. The control body is especially configured as a weight body. The weight body can provide a position compensation of the membrane carburetor.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
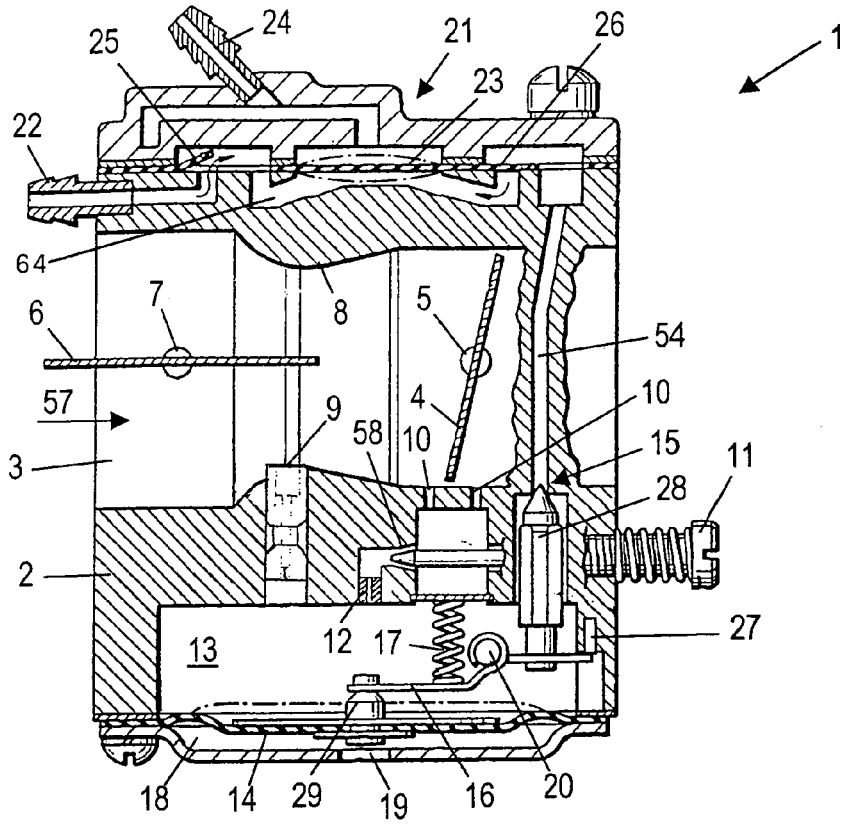
FIG. 1 is a section view of a membrane carburetor according to the invention.

The membrane carburetor 1 shown in FIG. 1 has a carburetor housing 2 through which a section of an intake channel 3 is extended. The intake channel 3 leads to an internal combustion engine. The internal combustion engine is especially the drive motor of a work tool in a portable handheld work apparatus such as a motor-driven chain saw, cutoff machine, brushcutter or the like. In the carburetor housing 2, a throttle flap 4 having a throttle shaft 5 is pivotally journalled in the intake channel 3. In lieu of the throttle flap 4, another throttle element can be mounted in the intake channel 3.

Referred to the flow direction 57, a choke flap 6 having a choke shaft 7 is pivotally journalled in the intake channel 3 upstream of the throttle flap 4. A venturi 8 is formed in the intake channel 3 between the choke flap 6 and the throttle flap 4 in the flow direction 57. In this region, a main fuel opening 9 opens into the intake channel. Downstream of the main fuel opening 9, ancillary fuel openings 10 open into the intake channel 3 in the region of the throttle flap 4. For the closed position of the throttle flap 4 shown in FIG. 1, especially an ancillary fuel opening 10 is disposed upstream and an ancillary fuel opening 10 is disposed downstream of the throttle flap 4.

The main fuel opening 9 and the ancillary fuel openings 10 are supplied by a control chamber 13. The ancillary fuel openings 10 are connected to the control chamber 13 via a throttle 12 and via an opening 58. The flow cross section of the opening 58 can be controlled via an idle adjusting screw 11. The control chamber 13 is delimited by a control membrane 14. The control membrane 14 separates the control chamber 13 from a compensation chamber 18 mounted on the opposite-lying side of the control membrane 14. The compensation chamber 18 is connected to the ambient via a compensation opening 19. The compensation chamber 18 can, however, also be connected to the clean side of an air filter via which combustion air is inducted into the intake channel 3.

The control membrane 14 has an attachment bolt 29 to which a lever 16 is connected. The lever 16 is pivotally journalled on a bearing pin 20. A pressure spring 17 acts on the lever 16 between the attachment bolt 29 and the bearing pin 20. The pressure spring 17 presses the control membrane 14 in a direction toward the compensation chamber 18. On the lever arm, which lies opposite to the attachment bolt 29, a valve body 28 is supported on the lever 16. The valve body 28 closes a fuel line 54 which opens into the control chamber 13. The valve body 28 and the valve seat 35 shown in FIG. 2 conjointly define an inlet valve 15.

The fuel line 54 is fed by a fuel pump 21. The fuel pump 21 is mounted in the carburetor housing 2 and is driven by the fluctuating pressure in the crankcase of the internal combustion engine. The fuel pump 21 has a fuel stub 22 for connecting to a fuel tank. The fuel reaches a pump chamber 64 via the fuel stub 22 and a check valve 25. The pump chamber 64 is delimited by the pump membrane 23. The crankcase pressure operates on the opposite-lying side of the pump membrane 23. A pulse connection 24 is provided for connecting a connecting line to the crankcase. The fuel is moved from the pump chamber 64 via a check valve 26 into the fuel line 54.

During operation of the membrane carburetor 1, the fuel pump 21 pumps fuel into the fuel line 54. Combustion air flows in the intake channel 3 to the internal combustion engine. Fuel is drawn by suction from the main fuel opening 9 and the ancillary fuel openings 10. For this reason, the pressure in the control chamber 13 drops and the control membrane 14 is drawn in the direction of the control chamber 13. For this reason, the lever 16 is pivoted about the bearing pin 20 and opens the inlet valve 15. Fuel from the fuel line 54 can then flow into the control chamber 13. The pressure in the control chamber 13 increases and the control membrane 14 is deflected in the direction toward the compensation chamber 18 and the inlet valve 15 is closed because of the force of the spring 17. The lever 16 is coupled to the attachment bolt 29 only in a pivot direction. For a movement of the control membrane in the direction toward the control chamber 13, the attachment bolt 29 presses on the lever 16 so that the lever 16 moves with the control membrane 14. The lever 16 can lift up from the attachment bolt 29 for a movement in the opposite direction. The return movement takes place because of the force of the spring 17.

An actuating piston 27 of an acceleration pump acts on the lever 16 next to the support of the valve body 28. The acceleration pump 30 is shown schematically in FIG. 2. The acceleration pump 30 has a pump piston 31 which lies against a control edge 34 of the throttle shaft 5. The opposite-lying end of the pump piston 31 delimits a pump chamber 32. In the pump chamber 32, a spring 33 is mounted which is configured as a pressure spring and which presses the pump piston 31 against the control edge 34 of the throttle shaft 5.

Figure 2:
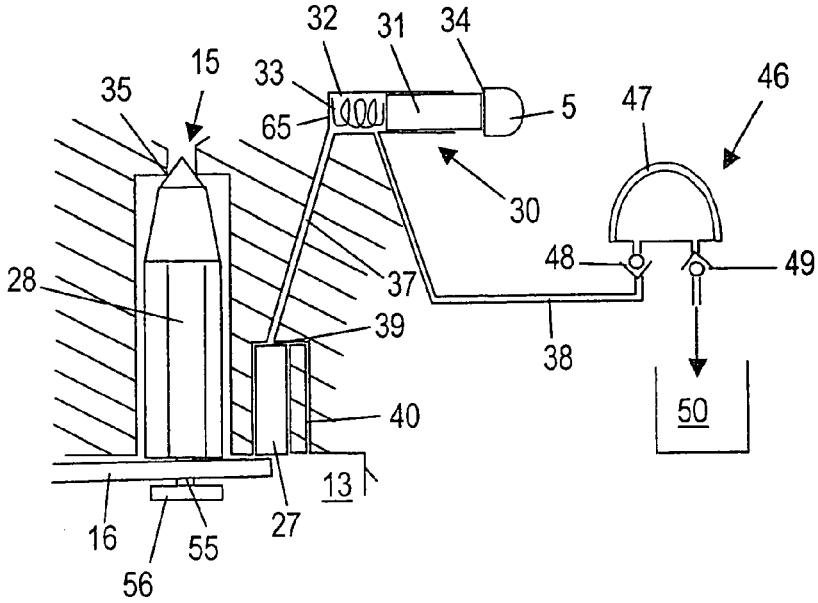
FIG. 2 is a schematic of the acceleration pump of the membrane carburetor in the nonactuated position.

In the embodiment of FIG. 2, the control edge 34 is configured as a flat of the throttle shaft 5. However, other contours for the control edge 34 can be provided. The control edge 34 can also be so configured that the pump piston 31 is actuated also during deceleration. An uncontrolled enrichment of the mixture during the deceleration operation can be avoided in this manner.

In FIG. 2, the pump piston 31 is shown in its nonactuated position. In this position, the piston 31 clears a first suction line 38 which opens into the pump chamber 32. The first suction line 38 connects the pump chamber 32 to a scavenging pump 46. The first suction line 38 opens via a check valve 48 into a pump diaphragm 47. The interior space of the pump diaphragm 47 is connected via a check valve 49 to a fuel tank 50. The check valves 48 and 49 open in flow direction from the pump chamber 32 to the tank 50 and lock in the opposite direction. The pump diaphragm 47 can be manually actuated.

The base 65 of the pump chamber 32 lies opposite the pump piston 31. In the region of the base 65, a pressure line 37 opens into the pump chamber 32. The pressure line 37 connects the pump chamber 32 to a pressure chamber 39 which is delimited by the actuating piston 27. The pressure chamber 39 is furthermore connected via a discharge opening 40 to the control chamber 13.

The actuating piston 27 acts on the lever 16. The valve body 28 is supported with play on the lever 16 via a bearing bolt 55 and a stop 56.

Before starting the internal combustion engine, the scavenging pump 46 is first actuated several times. In this way, fuel is moved from the control chamber 13 into the tank via the discharge opening 40, the pressure line 37, the pump chamber 32 and the suction line 38. For this reason, the pressure in the control chamber 13 drops so that the control membrane 14 is deflected and the inlet valve 15 is opened. In this way, fuel can be moved by the fuel pump 21 from the fuel tank 50 into the control chamber 13. By scavenging the fuel system, air bubbles, which have collected in the fuel path, are removed. This ensures that the pump chamber 32 is completely filled with fuel in advance of starting the internal combustion engine.

Figure 3:
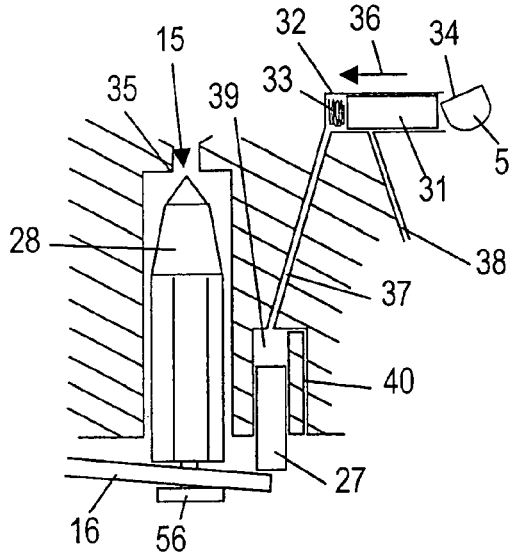
FIG. 3 is a schematic of the acceleration pump of FIG. 2 in the actuated position.

When accelerating the internal combustion engine, the throttle shaft 5 and the throttle flap 4 attached thereto are pivoted. The pivoted throttle shaft 5 is shown in FIG. 3. The pump piston 31 is pressed into the pump chamber 32 in the direction of arrow 36 because of the control edge 34. In this way, the suction line 38 to the scavenging pump 46 is first closed so that no fuel can escape into the scavenging pump 46. The pressures in the pump chamber 32 and the pressure line 37 increase because of the movement of the pump piston 31. The actuating piston 27 is pressed out of the pressure chamber 39 because of the increasing pressure. The actuation of the actuating piston 27 takes place hydraulically via the pressure line 37. The actuating piston 27 deflects the lever 16. Because of the stop 56, the valve body 28 is deflected together with the lever 16 so that the valve body 28 lifts from the valve seat 35 and the inlet valve 15 opens. The opened inlet valve 15 effects a pressure increase in the control chamber 13 which leads to a mixture enrichment in the intake channel 3. Furthermore, because of the opened inlet valve 15, a pressure drop in the control chamber 13 is avoided so that an adequate quantity of fuel can be supplied to the intake channel 3 for the further acceleration operation.

The pressure in the pressure chamber 39 drops via a throttling device in the form of the discharge opening 40 after the acceleration because the fuel can flow from the pressure chamber 39 via the discharge opening 40 into the control chamber 13. The lever 16 can reset after the acceleration operation. Because of the force of the spring 17, the actuating piston 27 is pressed back into its start position and the inlet valve 15 is closed. Enrichment of the mixture therefore takes place only during accelerations. If the throttle flap 4 is closed and the throttle shaft 5 is displaced from the position shown in FIG. 3 into the position shown in FIG. 2, then the piston 31 moves back into its start position opposite to the arrow 36 shown in FIG. 3. Fuel is then drawn by suction via the discharge opening 40 and the pressure line 37 into the pump chamber 32. With the next acceleration, this fuel is available for the hydraulic actuation of the actuating piston 27.

Figure 4:
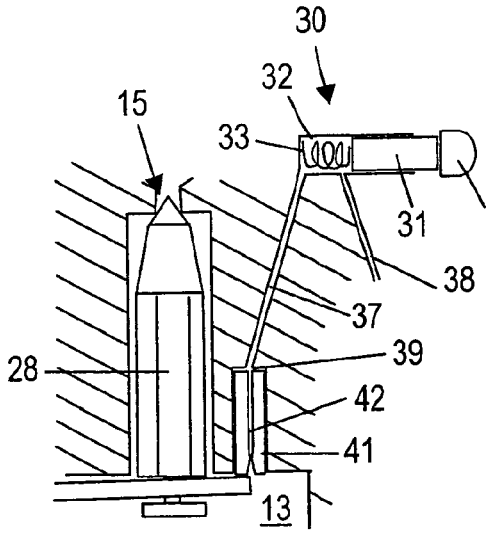
FIG. 4 to FIG. 9 show the accelerator pump in the nonactuated position; and, FIG. 10 is a schematic showing the accelerator pump of FIG. 9 in the actuated position.

In FIG. 4, an embodiment of an acceleration pump 30 is shown wherein an actuating piston 41 is shown in the pressure chamber 39. A discharge bore 42 is arranged in the actuating piston 41 and this discharge bore 42 connects the pressure chamber 39 to the control chamber 13. The discharge opening 40 in the carburetor housing 2 and the discharge bore 42 in the actuating piston 41 are calibrated and determine how long a mixture enrichment should still take place after an acceleration. An adjustment of the acceleration operation can take place via a suitable design of the discharge opening and/or the discharge bore.

Figure 5:
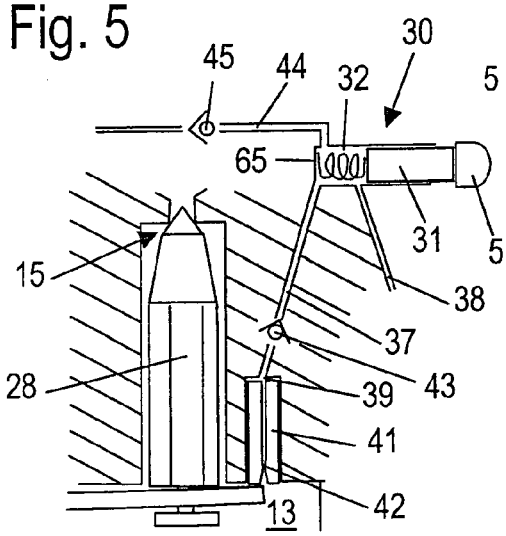

A further embodiment of a scavenging pump 30 is shown in FIG. 5. The same reference numerals are used in all figures for the same components. A second suction line 44 opens in the pump chamber 32 of the acceleration pump 30 shown in FIG. 5 in the region of the base 65 and this suction line 44 connects the pump chamber 32 to the control chamber 13. In the second suction line 44, a check valve 45 is mounted which opens in the direction from the control chamber 13 to the pump chamber 32 and closes in the opposite direction. With an actuation of the scavenging pump 46 (not shown in FIG. 5), fuel is drawn by suction from the control chamber 13 via the suction line 44 into the pump chamber 32. The suction line 44 can be configured with a comparatively large diameter and has no throttle like the discharge opening 40 and/or the discharge bore 42. For this reason, the scavenging of the control chamber 13 and the pump chamber 32 is facilitated. Additionally, a check valve 43 can be mounted in the pressure line 37 and this check valve 43 opens from the pump chamber 32 to the pressure chamber 39 and closes in the opposite direction. In this way, it is ensured that no fuel is drawn back by suction into the pump chamber 32 via the pressure line 37. In the embodiment of FIG. 5, the fuel is drawn by suction into the pump chamber 32 via the second suction line 44 during a deceleration. It can, however, also be provided that no check valve 43 is mounted in the pressure line 37 so that fuel can be drawn back into the pump chamber 32 by suction via the suction line 44 as well as via the pressure line 37.

Figure 6:
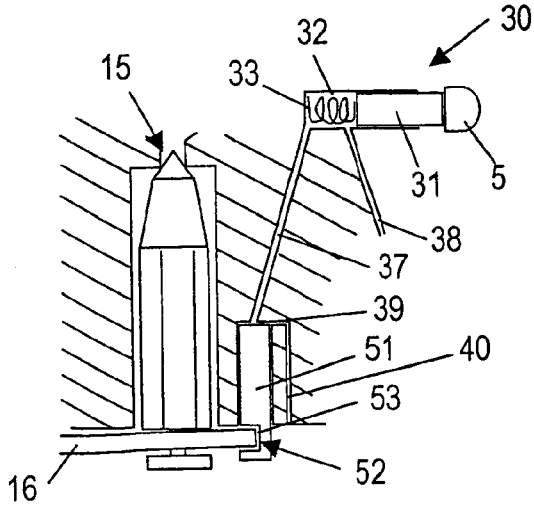

The embodiment of an acceleration pump 30 shown in FIG. 6 corresponds essentially to the embodiment shown in FIGS. 2 and 3. However, an actuating piston 51 is supported in the pressure chamber 39 and this actuating piston 51 provides for a fixation 52 for the lever 16. The fixation 52 is configured as a slot 53 in the actuating piston 51 and causes the lever 16 to be coupled to the movement of the actuating piston 51 for a stroke direction of the piston into the pressure chamber 39 as well as for a stroke direction out of the pressure chamber 39. For an acceleration, the actuating piston 51 is pressed out of the pressure chamber 39 and pivots the lever 16 so that the inlet valve 15 is opened. For a deceleration, the piston 51 is pulled into the pressure chamber 39. Because of the fixation 52, the actuating piston 51 takes the lever 16 along and so closes the inlet valve 15. Also, the control membrane 14 is deflected into a neutral position when it was deflected into the control chamber 13. In this way, it is ensured that, for a deceleration, no additional fuel metering into the intake channel 3 takes place. Should the actuating piston 51 be already completely disposed in the pressure chamber 39 at the start of the deceleration and the inlet valve 15 be closed, then the acceleration pump 30 effects no further movement of the actuating piston 51 or of the lever 16.

Figure 7:
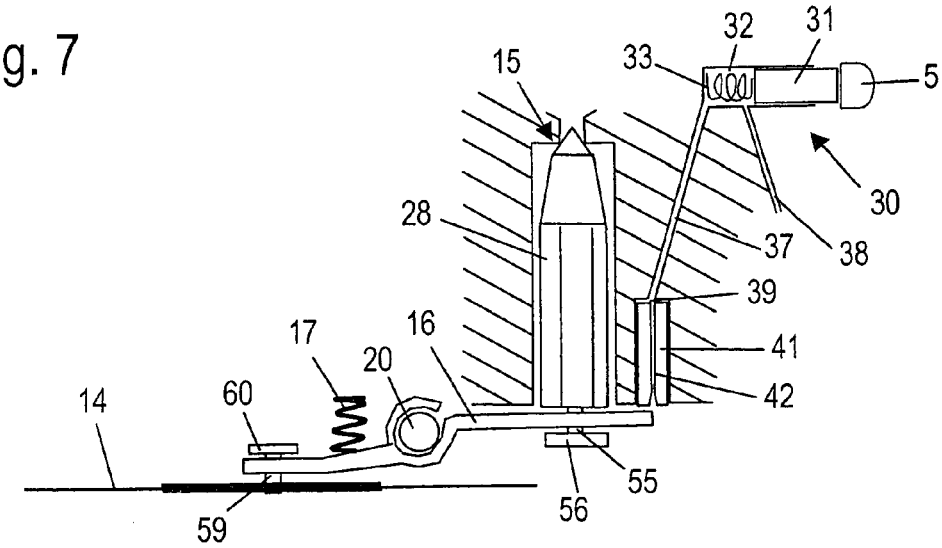

In FIG. 7, a further embodiment is shown which corresponds essentially to the embodiment of FIG. 4. However, the lever 16 is so attached to the control membrane 14 that pivot movements of the lever 16 in both rotational directions about the bearing pin 20 are transmitted to the control membrane 14. For this purpose, the lever 16 is fixed to the control membrane 14 with an attachment bolt 59 on which a stop 60 is arranged. The lever 16 is mounted with play on the control membrane 14. When the throttle shaft 5 is rotated and the pump piston 31 is pressed into the pump chamber 32 thereby and the actuating piston 41 is pressed out of the pressure chamber 39, then the lever 16 in FIG. 7 pivots about the bearing pin 20 in the clockwise direction. The lever 16 takes the control membrane 14 along because of the stop 60 and deflects the control membrane 14 in the direction toward the control chamber 13. In this way, the pressure in the control chamber 13 is increased so that a greater enrichment of the mixture in the intake channel 3 results.

Figure 8:
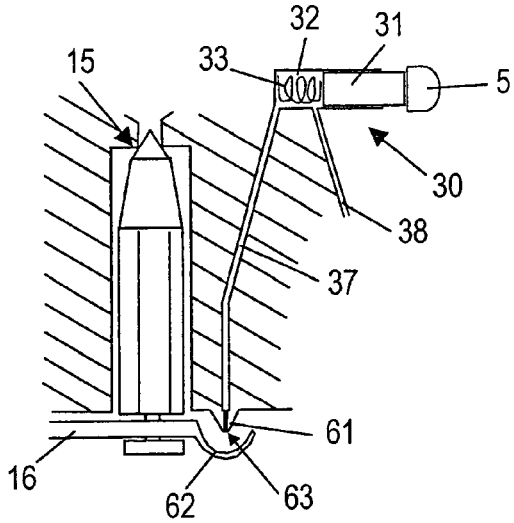

In the embodiment shown in FIG. 8, the pressure line 37 opens into the control chamber 13 with a nozzle 61. A spoon-shaped section 62 is formed on the lever 16 which engages over a nozzle discharge opening 63 of the nozzle 61. When the pump piston 31 is pressed into the pump chamber 32, then the fuel is pressed via the pressure line 37 through the nozzle 61 into the control chamber 13. The fluid exiting from the nozzle 61 forms a liquid jet which flows into the spoon-shaped section 62 and moves this section 62 away from the nozzle 61 because of the pulse of the fluid jet. In this way, the inlet valve 15 is opened. The forces, which are needed for actuating the lever, are very slight so that the fluid jet is sufficient for opening the inlet valve.

Figure 9:
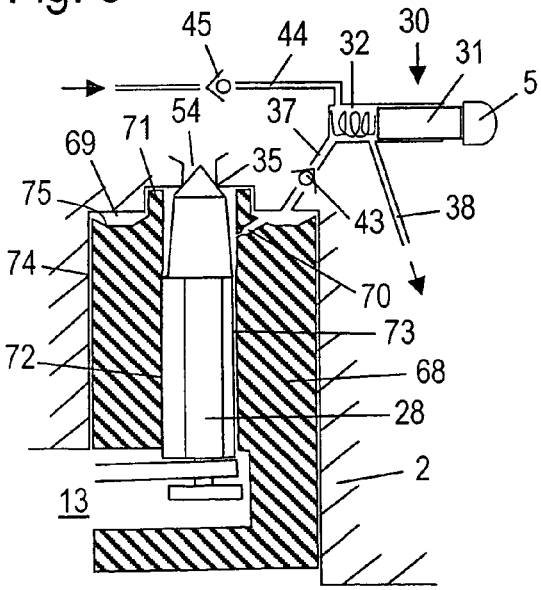
Figure 10:
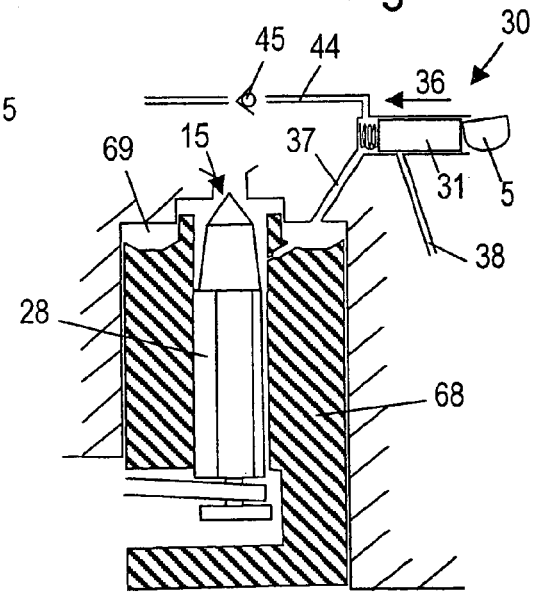

In the embodiment shown in FIGS. 9 and 10, a weight body 68 is fixed on the valve body 28. The weight body 68 is guided in a bore 74 in the carburetor housing 2. At its end projecting into the bore 74, the weight body 68 has an annular slot 75 which delimits an annularly-shaped pressure chamber 69. The annularly-shaped pressure chamber 69 is connected to the control chamber 13 via a compensating opening 70. The compensating opening 70 opens at a center bore 72 in the weight body 68 next to the fuel line 54. A connecting channel 73 is formed between the weight body 68 and the valve body 28 and this connecting channel 73 connects the fuel channel 54 and the compensating opening 70 to the control chamber 13. The weight body 68 has a sealing stub 71 at the periphery of the valve seat 35 and this sealing stub 71 closes off the annularly-shaped pressure chamber 69 relative to the fuel line 54 and the interior of the bore 72. The pump chamber 32 of the acceleration pump 30 is connected via the suction line 44 to the control chamber 13. A check valve 43 is mounted in the pressure line 37.

As FIG. 10 shows, a displacement of the pump piston 31 in the direction of arrow 36 effects a pressure increase in the pressure chamber 69 which effects a deflection of the weight body 68 into the control chamber 13. The weight body 68 is connected to the valve body 28 and takes the valve body 28 along so that the inlet valve 15 is opened. In this way, the pressure in the control chamber 13 increases and a mixture enrichment takes place.

The weight body 68 functions to compensate position. The weight of the weight body 68 counteracts the weight of the control membrane and the weight of the liquid column between the fuel openings (9, 10) and the control chamber 13. In this way, for each position of the membrane carburetor 1, similar weight ratios result at the lever 16 so that a position-independent control characteristic results. At the same time, the weight body 68 defines an actuating piston for the inlet valve 15.

The weight body 68 can be configured as one piece with the valve body 28 of the inlet valve 15. In this way, the number of necessary components is reduced. The weight body 68 can be made of a material having a comparatively high mass such as solid metal. In lieu of the weight body 68, an identically configured control body made of a material having lesser density such as plastic can be provided. For weight reduction, the control body can also be configured so as to be hollow.

It is understood that the foregoing description is that of the preferred embodiments of the invention and that various changes and modifications may be made thereto without departing from the spirit and scope of the invention as defined in the appended claims.

What is claimed is:

1. A membrane carburetor comprising:

a control chamber;

an intake channel;

at least one fuel opening connecting said control chamber to said intake channel;

a deflectable control membrane delimiting said control chamber;

fuel supply means for supplying fuel to said control chamber;

said fuel supply means including an inlet valve; and, a fuel line opening into said control chamber via said inlet valve;

said control membrane being operatively connected to said inlet valve so as to open said inlet valve in dependence upon deflections of said control membrane;

a throttle element mounted in said intake channel so as to be moveable in position;

an accelerator pump operatively connected to said throttle element so as to be actuated in dependence upon the position of said throttle element;

said control chamber having an actuating member disposed therein; and, said accelerator pump being hydraulically connected to said actuating member so as to permit said accelerator pump to act hydraulically on said actuating member.

2. The membrane carburetor of claim 1, said accelerator pump including an enclosure defining a pump chamber; a pump piston delimiting said pump chamber; and, a pressure line leading from said pump chamber and said accelerator pump acting on said actuating member via said pressure line.

3. The membrane carburetor of claim 2, further comprising:

a scavenging pump;

a suction line connecting said pump chamber to said scavenging pump; and, said suction line opening into said pump chamber at a location thereof whereat said suction line is closed by said pump piston when said pump piston is actuated.

4. The membrane carburetor of claim 3, wherein said suction line is a first suction line; and, wherein said membrane carburetor further comprises a second suction line opening into said pump chamber and connecting said pump chamber to said control chamber; and, a check valve mounted in said second suction line so as to open in flow direction to said pump chamber.

5. The membrane carburetor of claim 4, further comprising a check valve mounted in said pressure line so as to open in flow direction from said pump chamber.

6. The membrane carburetor of claim 1, wherein said actuating member is said inlet valve.

7. The membrane carburetor of claim 6, wherein said inlet valve is opened by said accelerator pump when there is acceleration.

8. The membrane carburetor of claim 6, wherein said inlet valve is closed by said accelerator pump when there is deceleration.

9. The membrane carburetor of claim 1, wherein said actuating member is said control membrane.

10. The membrane carburetor of claim 1, further comprising a lever mounted in said control chamber for coupling the position of said inlet valve to the position of said control membrane; and, said lever being said actuating member and said accelerator pump acting on said lever.

11. The membrane carburetor of claim 10, wherein said lever is pivotally mounted in said control chamber and said control membrane is coupled in both pivot directions to the movement of said lever.

12. The membrane carburetor of claim 11, wherein said control membrane is coupled with play to the movement of said lever.

13. The membrane carburetor of claim 3, wherein said pressure line is connected to said control chamber via a throttling device.

14. The membrane carburetor of claim 2, further comprising: an enclosure defining a pressure space and said pressure line opening into said pressure space; and, an actuating piston delimiting said pressure space; and, said actuating piston being operatively coupled to said actuating member for actuating said actuating member.

15. The membrane carburetor of claim 14, wherein said throttle element is configured as a relief bore in said actuating piston.

16. The membrane carburetor of claim 14, further comprising a lever mounted in said control chamber for coupling the position of said inlet valve to the position of said control membrane; and, said actuating piston being operatively connected to said lever for acting thereon.

17. The membrane carburetor of claim 16, wherein said actuating piston is connected to said lever via a fixation which transmits a stroke of said actuating piston in both directions to said lever.

18. The membrane carburetor of claim 2, wherein said control chamber comprises a nozzle and said pressure line opens into said control chamber via said nozzle for supplying a fluid jet into said control chamber for actuating said actuating member.

19. The membrane carburetor of claim 18, further comprising a lever mounted in said control chamber for coupling the position of said inlet valve to the position of said control membrane; and, said fluid jet acting on said lever; and, said lever having a spoon-shaped section formed thereon and said spoon-shaped section being disposed to overlap the nozzle opening of said nozzle.

20. The membrane carburetor of claim 1, said inlet valve including a valve body and a valve seat coacting with said valve body for opening and closing said inlet valve; and, said inlet valve further including a control body tightly connected to said valve body.

21. The membrane carburetor of claim 20, said accelerator pump including an enclosure defining a pump chamber; a pump piston delimiting said pump chamber; and, a pressure line leading from said pump chamber; and, said membrane carburetor further comprising an enclosure defining a pressure space; said control body being configured as an actuating piston delimiting said pressure space; and, said pressure line opening into said pressure space.

22. The membrane carburetor of claim 20, wherein said control body is configured as a weight body.

* * * * *